US006165008A

United States Patent [19]

Wu et al.

[11] Patent Number: 6,165,008

[45] Date of Patent: Dec. 26, 2000

[54] ELECTRICAL CONNECTOR FOR FLEXIBLE FLAT CABLE

[75] Inventors: Ming Chuan Wu, Shun-Lin; Ta Chin Lee, Taichung; Shih Wei Hsiao, Tu-Chen, all of Taiwan

[73] Assignee: Hon Hai Precision Ind. Co., Ltd., Taipei Hsien, Taiwan

[21] Appl. No.: 09/467,091

[22] Filed: Dec. 10, 1999

[51] Int. Cl.[7] ..... H01R 12/24

[52] U.S. Cl. ..... 439/492; 439/607; 439/495

[58] Field of Search ..... 439/492, 495, 439/499, 260, 607, 497

[56] References Cited

U.S. PATENT DOCUMENTS

| | | | |
|---|---|---|---|
| 5,141,445 | 8/1992 | Little | 439/607 |
| 5,882,223 | 3/1999 | Igarashi | 439/607 |
| 6,066,000 | 5/2000 | Masumoto et al. | 439/607 |

*Primary Examiner*—Paula Bradley
*Assistant Examiner*—Tho D. Ta
*Attorney, Agent, or Firm*—Wei Te Chung

[57] ABSTRACT

An electrical connector for a flexible flat cable comprises a dielectric housing defining an elongate slot, a number of terminals retained in the housing, a shield enclosing the housing, and a stuffer inserted into the slot for biasing an inserted flexible flat cable into contact with the terminals. Each terminal has a tail portion for connecting with a signal conductor of the inserted cable. The shield comprises a pressing plate extending into the slot of the housing. The pressing plate connects with a bottom wall of the shield via a pair of linkers and is parallel to the bottom wall. Each linker is trapezoidal in shape. Each linker connects with the pressing plate at a first junction portion having a small width and with the bottom wall of the shield at a second junction portion having a large width, thereby preventing a top wall of the shield from upwardly deflecting relative to the housing.

7 Claims, 5 Drawing Sheets

ELECTRICAL CONNECTOR FOR FLEXIBLE FLAT CABLE

BACKGROUND OF THE INVENTION

1. Field of the Invention

The present invention relates to an electrical connector, and particularly to an electrical connector for a flexible flat cable having a top wall of a shield retained in reliable contact with a housing thereof.

2. Description of the Prior Art

As shown in FIGS. 4 and 5, an earlier invented electrical connector for a flexible flat cable 5, i.e. an FPC (Flexible Printed Circuit) connector, includes a dielectric housing 1 with a plurality of terminals 2 received therein. The housing 1 has an elongate slot 13 for receiving the flexible flat cable 5. A shield 3 encloses the housing 1 for EMI/RFI shielding. The shield 3 comprises a top wall 31, a bottom wall 32 opposite the top wall 31, a pair of opposite lateral walls 35, and a pressing plate 34 extending into a cavity defined between the top wall 31, the bottom wall 32 and the lateral walls 35. The top wall 31 further comprises a fixing plate 311 forwardly extending therefrom at a lower level for fitting into a shallow recess 16 defined in an upper surface 17 of the housing 1. The top wall 31 is connected with the bottom wall 32 via a pair of interconnecting portions 36 proximate the lateral walls 35. The pressing plate 34 is connected with the bottom wall 32 via a pair of rectangular linkers 33. Each linker 33 connects with the pressing plate 34 and the bottom wall 32 at first and second junction portions A and B, respectively.

A stuffer 4 is inserted between the pressing plate 34 and the bottom wall 32 of the shield 3 and is movable between a first, loading position and a final, terminating position. In the first, loading position, the flexible cable 5 is readily inserted into a space defined between the terminals 2 and the pressing plate 34 of the shield 3. In the final, terminating position, the stuffer 4 is further pushed inward to bias signal conductors 52 of the cable 5 into contact with the terminals 2 by an elongate flange 42 formed at a rear edge thereof.

One problem with such a design is that the top wall 311 of the shield 3 tends to deflect relative to the housing 1 during the forward push of the stuffer 4 to the final, terminating position. During this process, an upward force exerted by the stuffer 4 is acting on the pressing plate 34 whereby the shield 3 rotates anticlockwise (with reference to the view in FIG. 5) relative to the housing 1. Since the first junction portion A of the linker 33 has the same width as the second junction portion B, the bottom wall 32 is easily actuated to move upward by the linker 33. Such an upward movement of the bottom wall 32 results in an upward deflection of the top wall 31 relative to the housing 1 via the interconnecting portions 36. Such an upward deflection of the top wall 31 exceeds the preloading stress of the top wall 31. Thus, a significant gap G is defined between the free end of the fixing plate 311 of the shield 3 and the bottom of the recess 16 of the housing 1. When the width of the rectangular linker 33 is 2 mm, the amount of upward deflection of the top wall 31 reaches 0.21 mm. However, due to the miniaturization of the electrical connectors, the height of an FPC connector is generally only about 2 mm and the thickness of a pressing plate of a shield is only about 0.2 mm. Therefore, such a significant gap G is out of line with the miniaturization trend and is thus unacceptable in the art. Furthermore, such a significant gap G degrades the shielding efficiency of the shield 3 and thus adversely affects the electrical connection between the terminals 2 and corresponding complementary terminals.

Therefore, an electrical connector for a flexible flat cable solving the aforesaid problems is desired.

SUMMARY OF THE INVENTION

Accordingly, the main object of the present invention is to provide an electrical connector for a flexible flat cable having a top wall of a shield retained in reliable contact with a housing thereof thereby ensuring a proper electrical connection between the connector and a complementary connector.

To fulfill the above-mentioned object, an electrical connector for a flexible flat cable in accordance with the present invention comprises a dielectric housing defining an elongate slot, a plurality of terminals retained in the housing, a shield enclosing the housing, and a stuffer received in the elongate slot of the housing. Each terminal has a tail portion for connecting with signal conductors of an inserted flexible flat cable. The shield comprises a pressing plate connecting with a bottom wall thereof via a pair of trapezoidal linkers. Each linker connects with the pressing plate and the bottom wall at a small width junction portion and a large width junction portion, respectively. The pressing plate extends into the elongate slot of the housing for biasing the flexible flat cable into contact with the terminals retained in the housing.

The stuffer is inserted into a cavity defined between the pressing plate and the bottom wall of the shield and is movable between a first, loading position and a final, terminating position where the terminals are biased into contact with signal conductors of the inserted cable. When the stuffer is pushed inward to the final, terminating position, the bottom wall of the shield will not be readily actuated to deflect upward by the linkers since each linker connects with the pressing plate at a small width junction portion. Thus, the top wall of the shield connected with the bottom wall upwardly deflects only a small amount, which is equal to the preloading stress thereof. Therefore, a gap defined between the top wall and the housing will not occur and reliable EMI shielding is provided for the terminals in the housing.

Other objects, advantages and novel features of the invention will become more apparent from the following detailed description when taken in conjunction with the accompanying drawings.

DETAILED DESCRIPTION OF THE INVENTION

Figure 1:
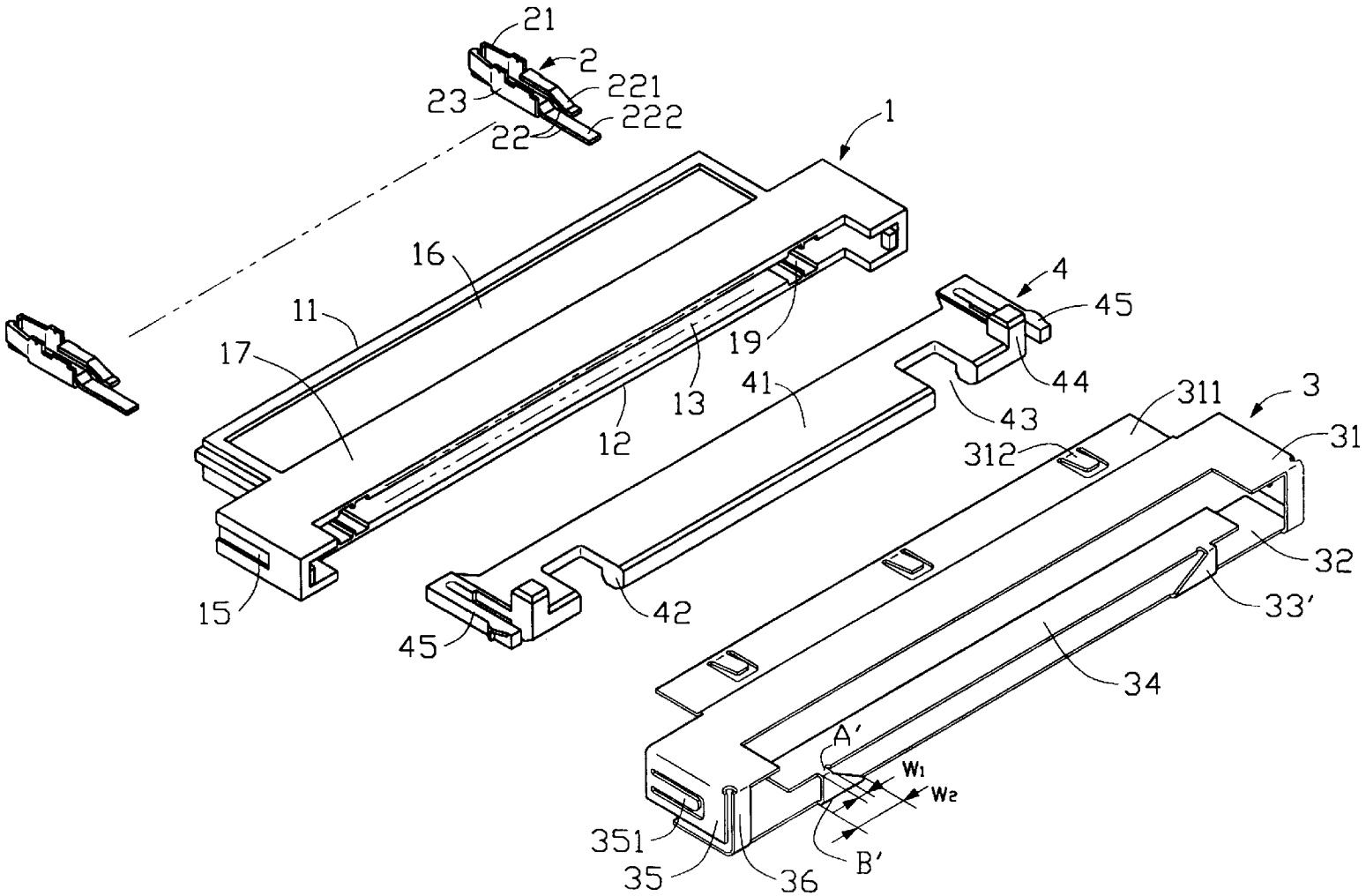
FIG. 1 is an exploded view of an electrical connector for a flexible flat cable in accordance with the present invention.

Referring to FIG. 1, an electrical connector for a flexible flat cable 5 (FIG. 3) in accordance with the present invention comprises a dielectric housing 1, a plurality of terminals 2 retained in the housing 1, a shield 3 enclosing the housing 1, and a stuffer 4 inserted into the housing 1.

The housing 1 has a mating surface 11 for connecting with a complementary connector (not shown), and a mounting surface 12 opposite the mating surface 11 for receiving the stuffer 4. A plurality of passageways 19 is defined between the mating surface 11 and the mounting surface 12 for receiving the terminals 2. A shallow recess 16 is defined in an upper surface 17 of the housing 1. An elongate slot 13 is defined in the mounting surface 12 in communication with the passageways 19. A groove 15 is defined in an outer lateral surface of the housing 1.

Each terminal 2 is unitarily stamped to include a U-shaped mating portion 21 at one end thereof, a tail portion 22 including upper and lower fingers 221 and 222 at the other end thereof, and a retaining portion 23 between the mating portion 21 and the tail portion 22.

Figure 3:
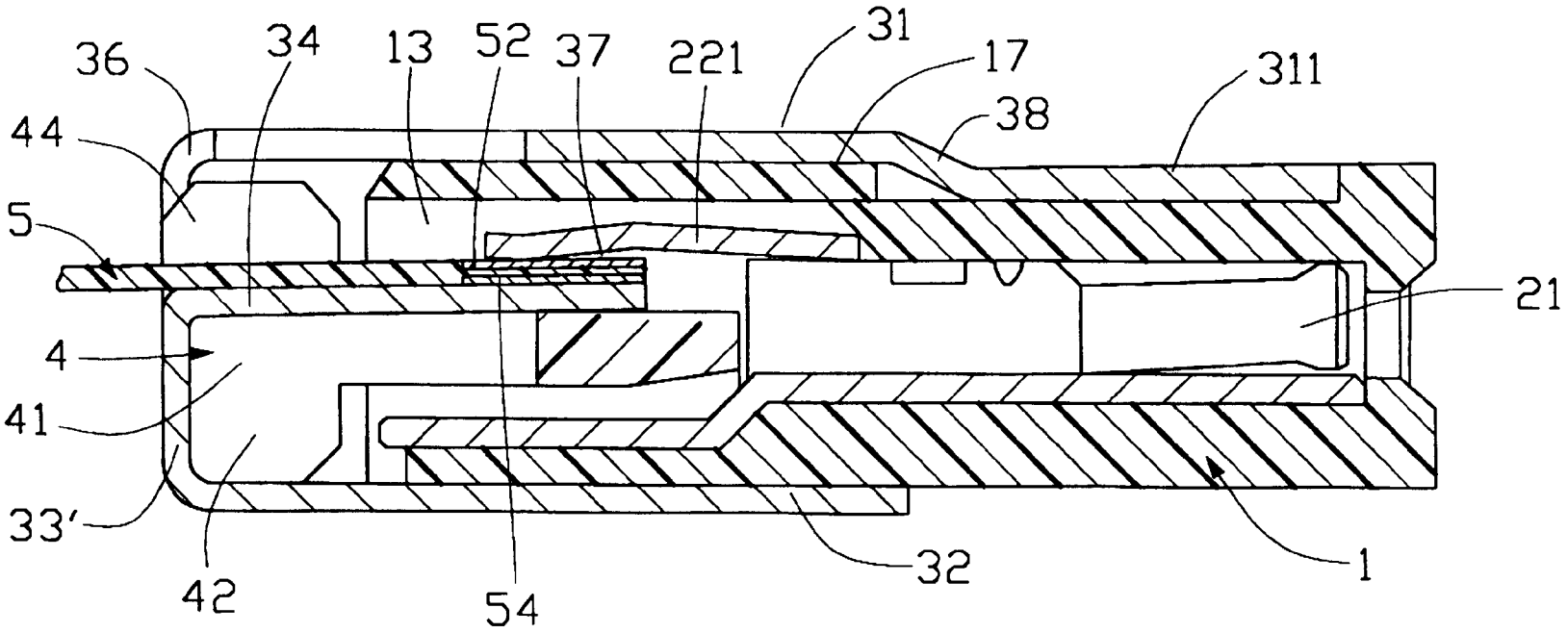
FIG. 3 is a cross-sectional view taken along line 3—3 of FIG. 2 but with a flexible flat cable inserted therein and with the stuffer thereof in a final, terminating position.
Figure 4:
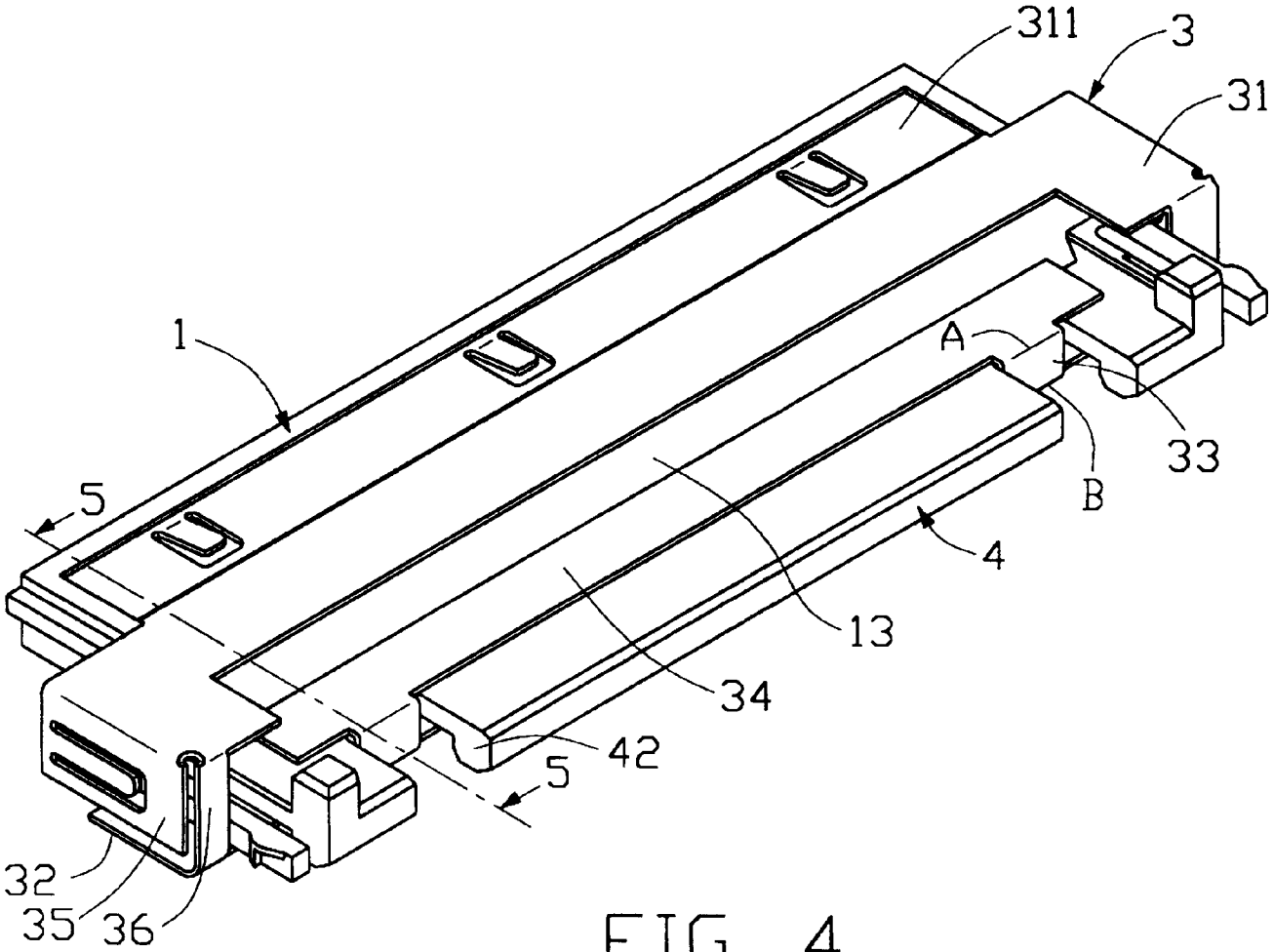
FIG. 4 (PRIOR ART)
FIG. 4 is a perspective view of an earlier invented electrical connector for a flexible flat cable with a stuffer in a first, loading position.

The shield 3 is unitarily stamped to include a top wall 31, a bottom wall 32, and a pair of opposite lateral walls 35 for cooperatively defining a space to accommodate the housing 1 thereby shielding the housing 1 from EMI. Each lateral wall 35 comprises a spring finger 351 stamped therein for engaging with the corresponding groove 15 of the housing 1. The bottom wall 32 connects with the top wall 31 via a pair of interconnecting portions 36 proximate the lateral walls 35. The top wall 31 further includes an elongate fixing plate 311 parallel to the bottom wall 32 and connecting with the top wall 31 via an inclined transition portion 38 (FIG. 3). A plurality of upwardly stamped lances 312 are formed in the fixing plate 311 for engaging with a corresponding grounding part of the complementary connector. An elongate pressing plate 34 is connected with a rear edge of the bottom wall 32 via a pair of trapezoidal linkers 33' and is parallel to the bottom wall 32. Each linker 33' connects with the pressing plate 34 at a junction portion A' having a small width $W_1$ and connects with the bottom wall 32 at a junction portion B' having a large width $W_2$.

The stuffer 4 includes an elongate body 41 and a pair of spring latch arms 45 at opposite ends of the body 41. The body 41 comprises an elongate flange 42 downwardly projecting from a rear edge thereof. A pair of cutouts 43 is defined in the rear edge of the body 41 on opposite sides of the flange 42. A pair of protrusions 44 is formed on opposite ends of the body 41 adjacent to the latch arms 45.

Figure 2:
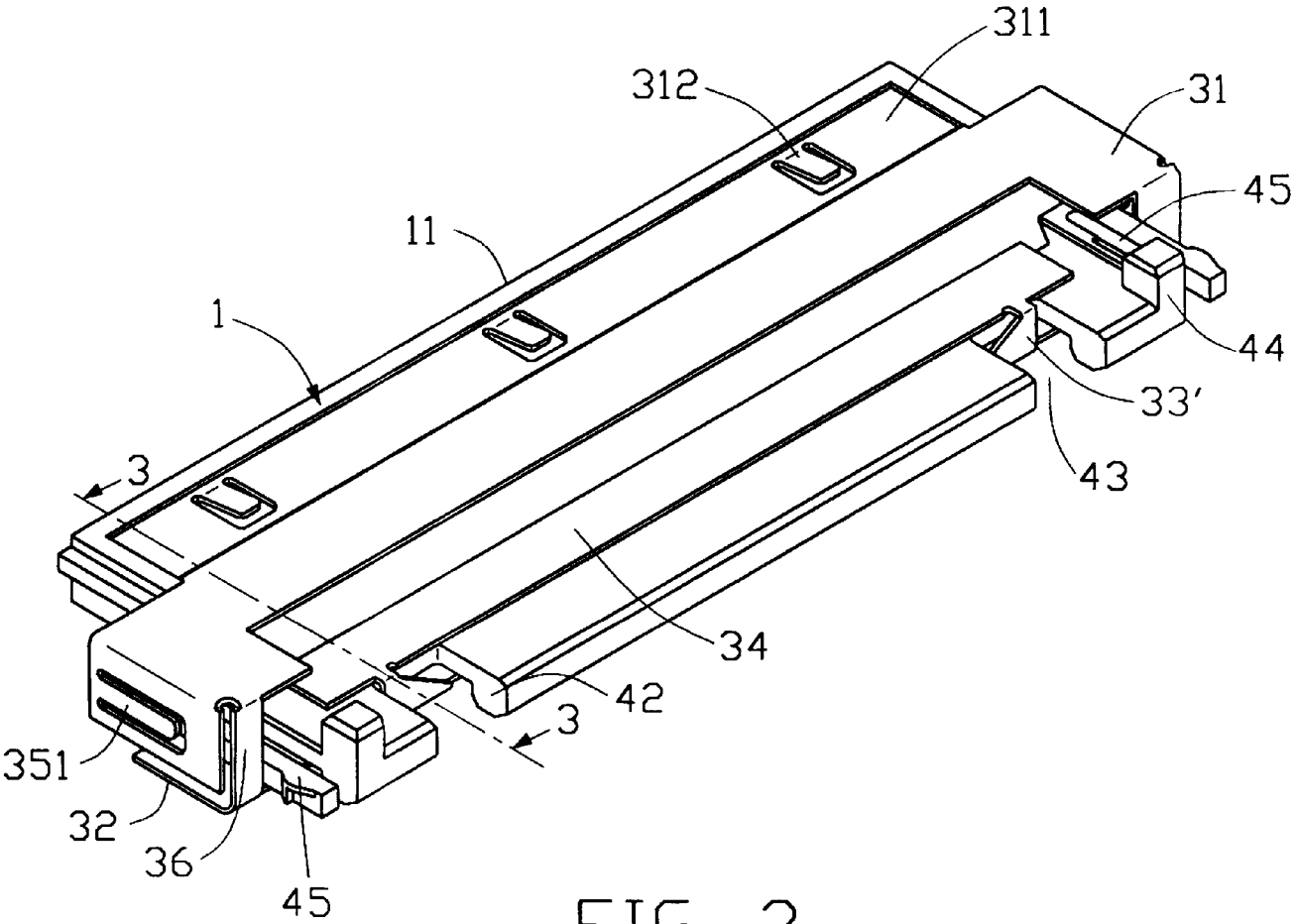
FIG. 2 is an assembled view of FIG. 1 with a stuffer thereof in a first, loading position.

FIG. 2 shows an assembled connector of the present invention in a first, loading position before the flexible flat cable 5 is inserted therein. In assembly, the terminals 2 are first inserted into the corresponding passageways 19 from the mounting surface 12 of the housing 1.

To assemble the stuffer 4 into the shield 3, the body 41 of the stuffer 4 is inserted between the pressing plate 34 and the bottom wall 32 of the shield 3. The flange 42 and the protrusions 44 protrude rearward from the shield 3, and the cutouts 43 receive the corresponding linkers 33' of the shield 3.

To assemble the stuffer-shield subassembly to the housing 1, the shield 3 encloses the housing 1 with the fixing plate 311 thereof interferentially received in the shallow recess 16 of the housing 1 and the spring fingers 351 thereof engaged with the corresponding grooves 15 of the housing 1.

In this first, loading position (shown in FIG. 2), a space 37 (see FIG. 3) is defined between the pressing plate 34 of the shield 3 and the upper fingers 221 of the terminals 2 for extension of the flexible flat cable 5.

FIG.3 shows the assembled connector of the present invention in a final, terminating position where the flexible flat cable 5 is retained therein. In assembly, a leading edge of the flexible cable 5 is inserted into the space 37 of the connector from a rear edge of the connector. The leading edge of the flexible cable 5 includes signal conductors 52 on a side thereof facing the upper fingers 221 of the terminals 2 and grounding conductors 54 on an opposite side thereof facing the pressing plate 34 of the shield 3. The shield 3 is further pushed inward from the first, loading position to the final, terminating position. The protrusions 44 of the stuffer 4 prevent a further inward movement of the stuffer 4 thereby securely engaging the stuffer 4 with the housing 1.

In the final, terminating position, the flange 42 of the stuffer 4 is pushed into a space defined between the pressing plate 34 and the bottom wall 32 of the shield 3. The inserted flange 42 forces the pressing plate 34 into an upward bias against the grounding conductors 54 of the flexible cable 5 thereby forcing the signal conductors 52 of the flexible cable 5 to contact the upper fingers 221 of the terminals 2. Thus, a reliable electrical connection between the flexible flat cable 5 and the terminals 2 is established.

During the process of pushing the stuffer 4 inward to the final, terminating position, an upward force is acting on the pressing plate 34 whereby the shield 3 tends to rotate anticlockwise relative to the housing 1 (with reference to the view in FIG. 3). Since the linker 33' is trapezoidal in shape, most of the stress is accumulated at the junction portion A' having the smaller width $W_1$, where large deformation occurs, and less stress is accumulated at the junction portion B' having the larger width $W_2$, where small deformation occurs.

Figure 5:
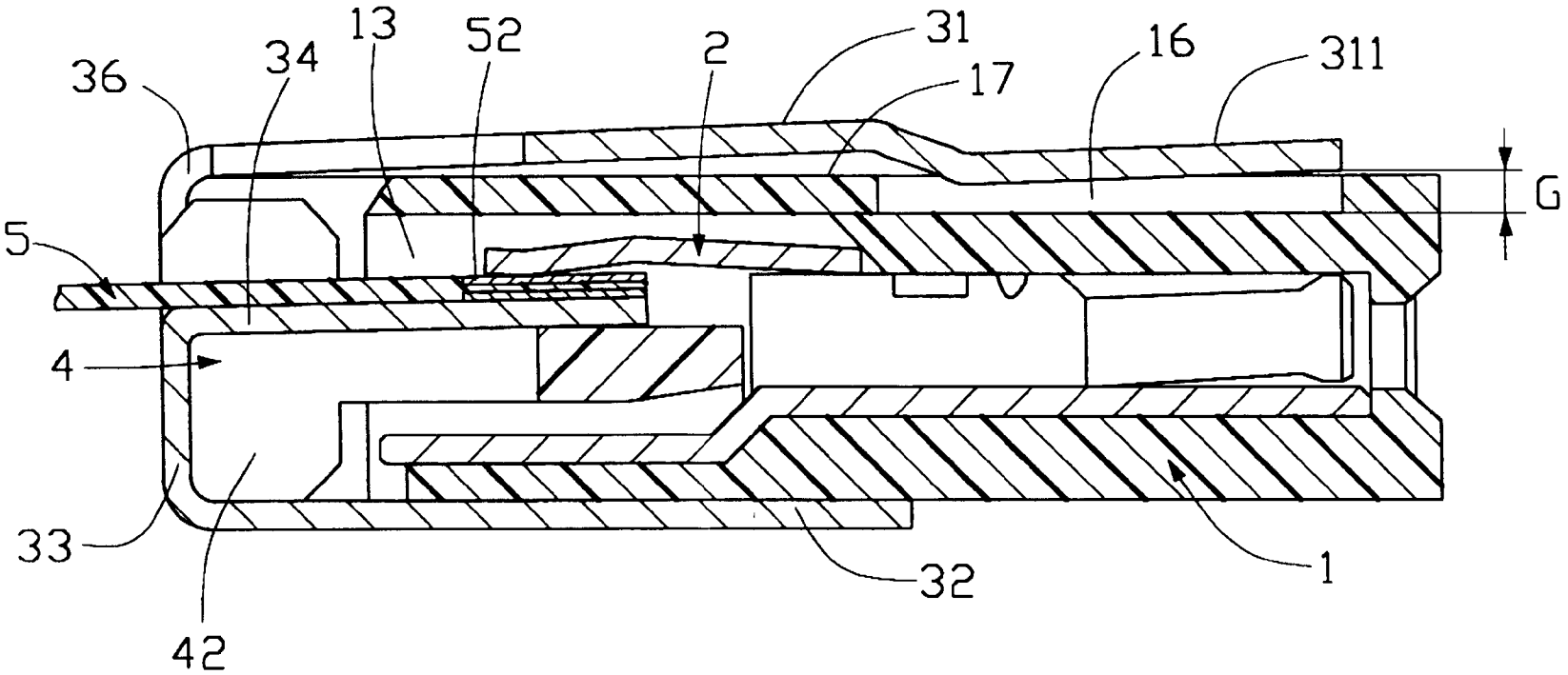
FIG. 5 (PRIOR ART)
FIG. 5 is a cross-sectional view taken along line 5—5 of FIG. 4 but with a flexible flat cable inserted therein and with the stuffer thereof in a final, terminating position.

A table provided below illustrates the relationship between the width $W_1$ of the linker at the junction portion A', the stress S at the junction portion A' and the resulting upward deflection G' at a front end of the fixing plate 311 of the top wall 31 (see FIG. 5 for analogous prior art gap G), given a constant width $W_2$=2 mm of the linker at the junction portion B'.

| Experiment No. (mm) | Width $W_1$ (mm) | Stress S (kg/mm$^2$) | Upward Deflection G' |
|---|---|---|---|
| 1 | 2.00 | 13.7 | 0.21 |
| 2 | 1.00 | 23.2 | 0.17 |
| 3 | 0.50 | 43.6 | 0.13 |

As illustrated in the above chart, when the larger width $W_2$ of the linker at the junction portion B' remains 2.00 mm, the resulting stress S at the junction portion A' increases as the smaller width $W_1$ of the linker at the junction portion A' decreases and the upward deflection G' of the fixing plate 311 gradually decreases with the decrease in the width $W_1$. When the width $W_1$ is 0.5 mm, the upward deflection G' is significantly reduced to 0. 13 mm. To prevent the linker from breaking due to the large amount of accumulated stress, the preferred small width $W_1$ of the linker is 0.7 mm, where the amount of upward deflection G' of the fixing plate 311 of the shield 3 relative to the housing 1 is 0.15 mm. Such an amount of deflection is equal to the preloading stress of the top wall 31. Thus, no gap will occur between the top wall 31 of the shield 3 and the housing 1 thereby retaining the top wall 31 of the shield 3 in position relative to the housing 1.

Due to the provision of the trapezoidal linker 33' with the small width at the junction portion A', the bottom wall 32 of the shield 3 will not be readily actuated to deflect upward when the stuffer 4 is pushed into its final, terminating position. Thus, the top wall 31 of the shield 3 connected with the bottom wall 32 will only deflect upwardly a small amount which is equal to the preloading stress of the top wall 31. Therefore, not only will a reliable connection between the inserted flexible flat cable 5 and the terminals 2 be ensured, but reliable EMI shielding will also be secured.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for a flexible flat cable comprising:

a dielectric housing having a plurality of passageways and a slot defined in a rear end thereof in communication with the passageways;

a plurality of terminals retained in the passageways;

a shield enclosing the housing and including a top wall, a bottom wall parallel to said top wall, an interconnecting portion connecting the top wall with the bottom wall, a pressing plate extending into the slot of the housing and parallel to said bottom wall, said pressing plate located between said top wall and said bottom wall, and a pair of linkers connecting the pressing plate with the bottom wall, each linker having a first and a second junction portions respectively connecting with the pressing plate and the bottom wall, the first junction portion having a width smaller than the second junction portion for preventing the top wall of the shield from deflecting away from the housing; and a stuffer confined to be movable between the dielectric housing and the shield for biasing the pressing plate of the shield to be in contact with the flexible flat cable without significantly deflecting the top wall of the shield from the housing.

2. The electrical connector as described in claim 1, wherein the width of the first junction portion of each linker is so chosen that a given force applied to the pressing plate causes a limited turning movement of the bottom wall.

3. The electrical connector as described in claim 1, wherein each linker is trapezoidal in shape.

4. The electrical connector as described in claim 1, wherein the stuffer comprises a pair of cutouts defined in a rear edge thereof for receiving the linkers of the shield.

5. The electrical connector as described in claim 1, wherein the stuffer comprises a downwardly projecting flange for pressing the inserted flexible flat cable to be in contact with the terminals and the pressing plate of the shield.

6. A shield for use with a flexible flat cable connector, comprising:

a top wall and a bottom parallel to said top wall;

an interconnecting portion connected between said top wall and said bottom wall; and a pressing plate extending into a space between said top wall and said bottom wall, said pressing plate extending parallel to the bottom wall with a pair of linkers connected therebetween, each linker defining first and second junction portions respectively connecting to the pressing plate and the bottom wall; wherein the first junction portion has a width smaller than that of the second junction portion so that upward deflection of the pressing plate does not result in significant upward deflection of the top wall.

7. An electrical connector assembly comprising:

a dielectric housing having a plurality of passageways and a slot defined in a rear end thereof in communication with the passageways;

a plurality of terminals retained in the passageways;

a shield enclosing the housing and including a top wall, a bottom wall parallel to said top wall, an interconnecting portion connecting the top wall with the bottom wall, a pressing plate extending parallel to said bottom wall, said pressing plate horizontally extending into the slot of the housing, and a pair of linkers connecting the pressing plate with the bottom wall, each linker having a first and a second junction portions respectively connecting with the pressing plate and the bottom wall, the first junction portion having a width smaller than that of the second junction portion for preventing the top wall of the shield from being deflected away from the housing; and a stuffer biasing the pressing plate of the shield to be in contact with a flexible flat cable, which is received within the slot and sandwiched between the pressing plate and the terminals, without significantly deflecting the top wall of the shield above the housing.

* * * * *